United States Patent [19]

Boogers

[11] 4,253,906

[45] Mar. 3, 1981

[54] DEVICE FOR EMPTYING A BELT REEL OR BOBBIN FILLED WITH TOBACCO PORTIONS

[75] Inventor: Wilhelmus P. L. Boogers, Eindhoven, Netherlands

[73] Assignee: B.V. Arenco P.M.B., Best, Netherlands

[21] Appl. No.: 964,606

[22] Filed: Nov. 29, 1978

[30] Foreign Application Priority Data

Dec. 19, 1977 [NL] Netherlands ..... 7714082

[51] Int. Cl.[3] ..... B32B 31/16; A24B 3/16; B65G 47/22

[52] U.S. Cl. ..... 156/584; 131/138; 131/140 A; 131/149; 156/229; 156/344; 156/494; 156/542; 209/643; 221/253; 221/259; 271/4; 271/5; 271/6; 271/34; 271/DIG. 2

[58] Field of Search ..... 131/149, 138, 140 A; 156/229, 344, 542, 584, 494; 221/42, 253, 259; 271/4, 5, 6, 34, DIG. 2; 209/643

[56] References Cited

U.S. PATENT DOCUMENTS

| | | | |
|---|---|---|---|
| 2,445,338 | 7/1948 | Sowa | 131/140 A X |
| 3,387,613 | 6/1968 | McHugh | 131/149 X |
| 3,685,650 | 8/1972 | Walther et al. | 209/643 X |
| 3,985,603 | 10/1976 | Berner | 156/344 X |

*Primary Examiner*—John T. Goolkasian
*Assistant Examiner*—Robert A. Dawson
*Attorney, Agent, or Firm*—John P. Snyder

[57] ABSTRACT

A method and device for emptying a belt reel or bobbin filled with tobacco leaves or portions thereof, the belt being withdrawn from the bobbin and wound on a reel, while each time the tobacco leaf portions are removed from the corresponding strip of belt, wherein prior to the removal of each tobacco leaf portion the belt is stretched in excess of the normal tensile force required for winding off the belt in order to detach the tobacco leaf portion from the belt, which additional stretching effect need only be very slight in order to pick up all tobacco leaf portions without disturbance.

10 Claims, 3 Drawing Figures

DEVICE FOR EMPTYING A BELT REEL OR BOBBIN FILLED WITH TOBACCO PORTIONS

Figure 1:
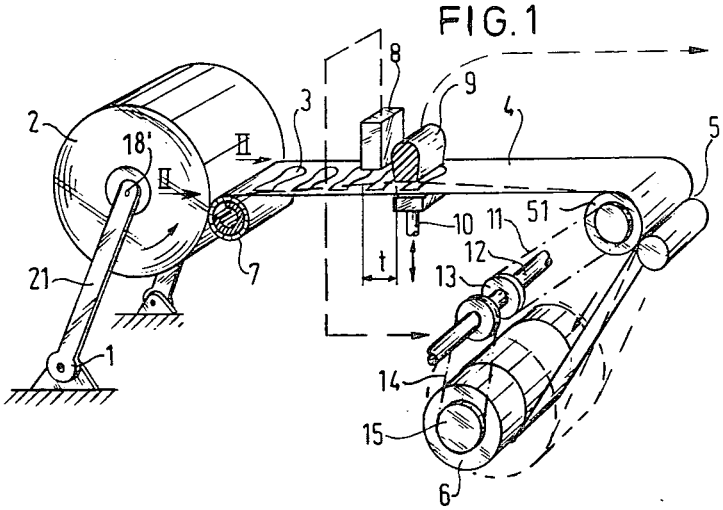

The invention relates to a method of emptying a belt reel or bobbin filled with tobacco leaves or portions thereof, the belt being withdrawn from the bobbin and wound on a reel, while each time the tobacco leaf portions are removed from the corresponding strip of belt.

A method of this kind has been used for a long time, though it involves the problem that during the removal the tobacco leaf portions do not readily disengage the belt so that disturbances may result. This is of frequent occurrence when the tobacco leaf portions have the shape of wrappers required for the manufacture of cigars.

The method according to the invention is distinguished in that prior to the removal of each tobacco leaf portion the belt is stretched in excess of the normal tensile force required for winding off the belt in order to detach the tobacco leaf portion from the belt.

In practice it has been found that this additional stretching effect need only be very slight in order to pick up all tobacco leaf portions without disturbance. This may be accounted for by the fact that the tobacco leaf portions are clamped between the turns of the bobbin for a long time so that a greater or lesser degree of adhesion is produced between the leaf portion and the belt material. By slightly stretching the belt in excess this adhesion is disturbed.

A preferred device for carrying out said method comprises a holder for the shaft of the bobbin, a take-up reel and means arranged between these parts for picking up each leaf portion from the stretched belt.

According to the invention this device is distinguished in that a member is arranged on the side of the belt remote from the tobacco portions for the local deformation of the stretched strip of belt. This deformation invariably introduces additional elongation of the belt as a result of which the adhesion between the tobacco leaf portion and the belt material is disturbed.

The deforming member may be designed in many forms, but in a preferred embodiment it is formed by a plate-shaped pressing surface movable at right angles to the strip of belt, which is thus moved from the stretched state into a pick-off state, while cyclically driven pick-up means can be disposed in and opposite said pressing surface. The pressing surfaces then serves simultaneously as a supporting surface for taking over the tobacco leaf portion.

The invention provides furthermore an improvement in retaining the tobacco leaf portions on the wound-off strip of belt. It may occur that the tobacco leaf portion remains stuck to the outer side of the bobbin. According to the invention a suction surface is used which is constantly in contact with the outer side of the bobbin. The strip of belt wound off is drawn across said suction surface.

Since the tobacco leaf portions have irregular shapes, there will always be an edge part of the leaf which is first released from between the turns. At this place the suction effect of the suction surface exceeds that of the further part thereof so that this leaf portion is safely retained on the strip of belt wound off. The remaining part of the leaf will automatically follow. The suction surface thus has an asymmetrical suction effect.

With the known suction surfaces in the form of perforated plates it is furthermore a disadvantage that the tobacco leaf shifts in place with respect to the apertures.

The invention proposes to construct the suction surface in the form of a perforated cylindrical sheath of a freely rotatable sleeve.

According to a further aspect the freely rotatable sleeve is journalled around a spindle having an axial slot communicating with a source of subatmospheric pressure. Owing to this step the consumption of air is materially reduced because the rotatable sleeve is closed on the non-operating side.

In order to maintain linear contact between the suction surface and the bobbin it is important for the bearings of the bobbin to be each arranged in a separate, freely movable bearing support so that the bobbin shaft becomes self-adjusting. The filled bobbin may have different shapes and the shape varies also when winding off.

Finally the invention proposes a control for actuating the belt each time over a distance sufficient for causing each tobacco leaf portion to register with the pick-up means. According to the invention this control is preferably obtained by means of a light-sensitive member responding to an intensity variation due to the presence or absence of tobacco on the belt of a light beam reflected by the belt or passing across the belt. The control includes furthermore a time delay in order to ensure that after the perception of an edge of the tobacco leaf portion the belt is drawn on over a fixed distance, which has to be sufficient for moving the tobacco leaf portion accurately into a position registering with the pick-up means.

The invention will be described more fully with reference to an embodiment.

In the drawing

Figure 2:
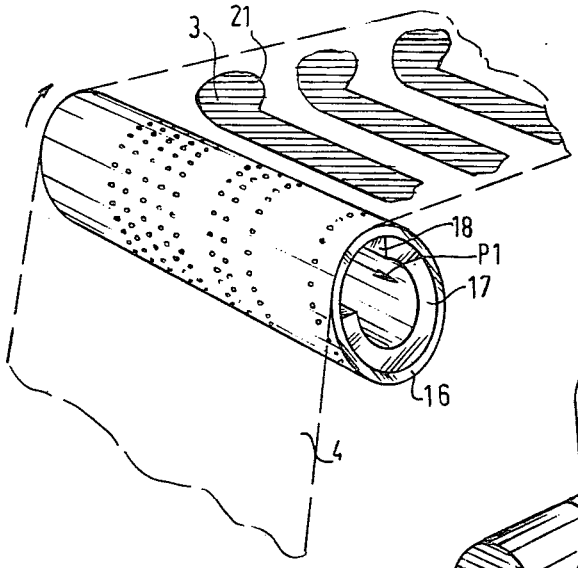
Figure 3:
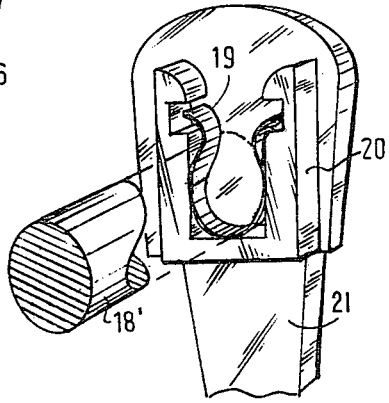

FIG. 1 is a perspective, schematic view of a device for winding off a filled bobbin, FIG. 2 is an elevational view in the direction of the arrow II—II in FIG. 1 of part of the device shown therein, FIG. 3 shows a detail of a bearing suspension of the bobbin shaft.

The device mainly comprises a holder 1 for the bobbin 2. The turns of the bobbin enclose tobacco leaf portions 3, which are located during winding off on the strip of belt 4 on the upper surface thereof. The strip of belt 4 is passed between a pair of clamping rollers 5 and then wound on a stock or winding-up reel 6.

The bobbin 2 is arranged in the holder 1 so that the outer surface of the bobbin is always bearing on a suction surface 7 by its own weight.

Above the strip of belt 4 are arranged in order of succession in the direction of movement a light-sensitive member 8 and a cyclically movable pick-up means 9, which can be moved out of a position as shown by guide meaans (not shown) to a further place in the machine and back thereto.

On the side of the strip of belt 4 remote from the carrying surface a deforming member or lifting table 10 is arranged opposite the pick-up means 9 being in the pick-up position.

According to one aspect of the invention the pick-up means 9 is held in the pick-up position at a given distance above the strip of belt 4 and by an actuation to be described more fully hereinafter the lifting table 10 will move upwards so that the strip of belt 4 is urged out of the stretched position shown into the form of an inverted V. The strip of belt 4 will thus be slightly elongated which is required for loosening the adhesion between the tobacco leaf portion 3 and the strip of belt 4. The pick-up means 9 can then pick up the tobacco leaf portion concerned without difficulty.

The stretched state of the strip of belt 4 is obtained by means of a pair of clamping rollers 5, the roller 51 of which is driven for example by a chain transmission 11 via a sprocket 13 journalled on the central driving shaft 12. The coupling between the shaft 13 and the shaft 12 is controllable in a manner such that the roller 51 can be intermittently driven so that the belt can advance stepwise.

The pick-up reel 6 is also driven through the central driving shaft 12 and a chain transmission 14, the shaft of the pick-up reel 6 having, however, a slip coupling 5 having such a slight resistance moment that it is just sufficient for winding up the portion of the belt located beneath the pair of clamping rollers 5 in order to avoid creases on the pick-up reel 6.

The suction surface 7 is shown in detail in FIG. 2. It comprises a cylindrical sleeve 16, the sheath of which is perforated in a defined pattern. It is shown in the Figure that on the left-hand side in the Figure a greater number of perforations is made than in the remaining part of the sheath so that an asymmetrical suction is obtained. This is important, for example, for the front edge 21 of each leaf portion 3 which comes first into contact with the curved part of the sheath 16 so that it is ensured that the leaf portion is carried along outwardly.

The sleeve 16 is journalled around a spindle 17 having an axial slot 18, which communicates with a source of subatmospheric pressure, which is indicated by the arrow P1. By mounting the spindle 17 in a rotatable manner the slot 18 can be adjusted to the optimum with respect to the belt 4 so that the suction effect starts at the correct spot.

It will be obvious that by closing the remaining part of the sheath 16 a low air consumption is ensured.

In order to hold the bobbin 2 at its place during the stepwise drive of the strip of belt 4 it is preferred to provide the bearings of the bobbin spindle 18' with a clamping spring 19, which serves as a braking mechanism (see FIG. 3).

The bearings are preferably accommodated in independently movable bearing supports formed in the embodiment shown in FIG. 1 by freely movable pivotal arms 21 so that with respect to the centre line of the suction surface 7 the shaft 19 can occupy an inclined position. It is thus ensured that the strip 4 to be withdrawn from the bobbin 2 winds off uniformly along the suction surface 7.

The drive and the lifting table 10 are preferably controlled by means of a light-sensitive member 8, which is disposed at a given distance T from the pick-up element 9. The light-sensitive member preferably scans the rear edge of the tobacco leaf portion, while the control includes a time delay (not shown) such that after the signal from the light-sensitive member 8 the roller 51 turns through a fixed angle of rotation so that the strip of belt 4 is advanced over the distance T. Thus the pick-up means 9 registers with the tobacco leaf portion 3 to be removed, which ensures an undisturbed operation.

Lifting of the table 10 may also be controlled by means of the light-sensitive element 8 but also by the drive of the pick-up element 9. The invention is not limited to the embodiments depicted above and, in particular, the lifting table 10 or the deforming member 10 may be constructed in a different manner. For example, a hexagonal cylinder may be rotatably arranged beneath the belt, which provides a similar deformation effect. Moreover, additional engaging elements may be arranged on both sides of the pick-up means 9 for additionally stretching the belt portion beneath the pick-up element 9.

What is claimed is:

1. Apparatus for emptying a reel or bobbin which is in the form of a belt wound upon itself and having discrete portions of tobacco sandwiched between the successive layers of the bobbin, which comprises:

support means for supporting the bobbin during unwinding of the belt therefrom;

unwinding means for unwinding the belt from the bobbin, said unwinding means being spaced from said support means whereby a length of belt is disposed therebetween and upon one surface of which discrete portions of tobacco are exposed;

brake means for causing said length of belt to be tensioned under the action of said unwinding means;

removal means disposed adjacent said one surface of the length of belt for successively removing the discrete portions of tobacco therefrom; and means for altering the tension of said length of belt when a discrete portion of tobacco is registered with said removal means, the tension of the belt being altered sufficiently to assure loosening of the tobacco from said one surface.

2. Apparatus as defined in claim 1 including suction means adjacent said support means for assuring that the discrete portions of tobacco are disposed on said one surface of the belt as the belt is unwound.

3. Apparatus as defined in claim 1 or 2 wherein said removal means is a suction head.

4. Apparatus as defined in claim 3 wherein said means for altering the tension comprises a member disposed on the side of the belt directly opposite said removal means and mechanism for moving said member to engage said belt and urge it toward said removal means.

5. Apparatus as defined in claim 1 or 2 wherein said means for altering the tension comprises a member disposed on the side of the belt directly opposite said removal means and mechanism for moving said member to engage said belt and urge it toward said removal means.

6. Apparatus as defined in claim 2 wherein said suction means is in the form of a perforate roller sleeve.

7. Apparatus as defined in claim 6 wherein the perforations in said roller sleeve are asymmetrically distributed thereon.

8. Apparatus as defined in claim 7 including a fixed spindle journalling said sleeve and having an axially extending slot and the interior of said spindle being subjected to subatmospheric pressure.

9. Apparatus as defined in claim 1 or 2 wherein said support means comprises a shaft carrying said bobbin and a pair of separate, freely movable bearing supports journalling opposite ends of said shaft.

10. Apparatus as defined in claim 9 including a pair of arms each pivotally supported at one end to a common support and the opposite end of each of such arms carrying one of said shaft ends.

* * * * *